US008925725B1

(12) United States Patent
Burnett

(10) Patent No.: US 8,925,725 B1
(45) Date of Patent: Jan. 6, 2015

(54) PACKAGING OF AIR TREATMENT DEVICES

(75) Inventor: Gregg William Burnett, Royse City, TX (US)

(73) Assignee: Dust Free, LP, Royse City, TX (US)

( * ) Notice: Subject to any disclaimer, the term of this patent is extended or adjusted under 35 U.S.C. 154(b) by 296 days.

(21) Appl. No.: 13/355,155

(22) Filed: Jan. 20, 2012

(51) Int. Cl.
*B65D 85/20* (2006.01)

(52) U.S. Cl.
USPC ..... 206/446; 206/776; 206/769

(58) Field of Classification Search
USPC ..... 206/446, 416, 775, 776, 781, 769, 771, 206/765
See application file for complete search history.

(56) References Cited

U.S. PATENT DOCUMENTS

| | | | | |
|---|---|---|---|---|
| 3,941,300 | A * | 3/1976 | Troth | 229/5.5 |
| 4,727,705 | A * | 3/1988 | Zahka | 53/425 |
| 5,005,759 | A * | 4/1991 | Bouche | 229/125.26 |
| 5,152,397 | A * | 10/1992 | Mayled | 206/486 |
| 5,813,523 | A * | 9/1998 | Gnadt et al. | 206/77.1 |
| 2007/0241027 | A1 * | 10/2007 | Yang | 206/580 |

OTHER PUBLICATIONS

Photo of Hot Wheels Mega Air Jumper Grave Digger package; downloaded from http://www.walmart.com/ip/Hot-Wheels-Mega-Air-Jumper-Monster-Jam-Grave-Digger/17756672?ci_sku=17756672&ci_src=14110944&sourceid=15000000000000003260420; on Jan. 20, 2012; (1 page).

Photo of Star Wars Republic Fighter Tank package: downloaded from http://www.walmart.com/search/search-ng.do?search_query=star+wars+republic+fighter&ic=16_0&Find=Find&search_constraint=4171; on Jan. 20, 2012; (1 page).

Photo of Mini Radio Control Kart package; downloaded from http://www.walmart.com/ip/Super-Mario-Yoshi-Radio-Controlled-Kart-1-24-Scale/16595256; on Jan. 20, 2012; (1 page).

Photo of Cars Launch & Race package; downloaded from http://www.walmart.com/ip/Disney-Cars-2-Pit-Stop-Launcher-Nigel-Gearsley-Aston-Martin-DB94/15940078; on Jan. 20, 2012; (1 page).

Photo of Batman Hot Wheels package; downloaded from http://www.walmart.com/ip/Hot-Wheels-Nostalgia-DC-Comics-4-Pack/17114368; on Jan. 20, 2012; (1 page).

Photo of Safari Express package; downloaded from http://www.walmart.com/ip/Wild-Republic-Train-Set-Zoo/17203218; on Jan. 20, 2012; (1 page).

Air Oasis nanoHCT Induct product page; found at http://www.airoasis.com/AOInducts.htm; on Jan. 20, 2012; (2 pages).

* cited by examiner

*Primary Examiner* — David Fidei
(74) *Attorney, Agent, or Firm* — Fogarty, L.L.C.

(57) ABSTRACT

Systems and methods for the packaging of air treatment devices are shown and described. In some embodiments, a package may be configured to store an air treatment device. For example, the air treatment device may be an air filter, cleaner, purifier, or the like. The package may include a first lateral surface configured to accommodate a proximal end of the air treatment device and a second lateral surface configured to accommodate a distal end of the air treatment device. The package may further comprise a middle surface coupled between the first and second lateral surfaces. In some cases, at least a portion of the first or second lateral surfaces may include an opaque area. Moreover, at least a portion of the middle surface may include a transparent or translucent area configured to reveal at least a portion of the air treatment device.

17 Claims, 7 Drawing Sheets

PACKAGING OF AIR TREATMENT DEVICES

TECHNICAL FIELD

This specification relates generally to packaging, and, more particularly, to systems and methods for packaging air treatment devices.

BACKGROUND

Air treatment devices such as, for example, air filters and purifiers, are designed to remove or reduce the amount of contaminants from the air. Generally speaking, these devices may be manufactured either as stand-alone units or as part of air handler units (AHU), heating, ventilation, and air conditioning (HVAC) systems, ventilation ducts, etc.

For example, a typical air treatment device may reduce odors, air pollutants, smoke, mold, bacteria, and viruses. In some cases, such devices may be installed or mounted into air conditioning and heating systems air ducts, where most air quality problems start. When an HVAC system is in operation, an air treatment device may oxidize pollutants, breaking them down into hydro-peroxides, super oxide ions, hydroxide ions, and/or other more friendly substances.

In many cases, air treatment devices are shipped and sold in cardboard packages. As the inventors hereof have recognized, however, these packages make it difficult for the customer (e.g., an HVAC contractor) to inspect the device without opening the box, for example, to determine its size and suitability for a particular project. Often, the customer does not know how the device is supposed to be installed or what it will look like after its installation. Moreover, once the customer removes the air treatment device from its packaging, it is subject to being damaged (e.g., the device's honeycomb panels and/or other more fragile elements can be particularly sensitive to the customer's handling), and/or it may have to be sold as an "open box item."

SUMMARY

Systems and methods for the packaging of air treatment devices are described. In an illustrative, non-limiting embodiment, a package may be configured to store an air treatment device. For example, the air treatment device may be an air filter, cleaner, purifier, or the like. The package may include a first lateral surface configured to accommodate a proximal end of the device and a second lateral surface configured to accommodate a distal end of the device. The package may further comprise a middle surface coupled between the first and second lateral surfaces. In some cases, at least a portion of the first or second lateral surfaces may include an opaque area. Moreover, at least a portion of the middle surface may include a transparent or translucent area configured to reveal at least a portion of the device.

In another illustrative, non-limiting embodiment, a package may include a first portion having a first surface configured to accommodate a proximal end of an air treatment device, a center portion coupled to the first end portion, and a second portion coupled to the center portion, the second portion having a second surface configured to accommodate a distal end of the air treatment device. In some implementations, the proximal end of the air treatment device may have a shape different from the distal end of the air treatment device. Further, at least one of the first, second, or center portions may include a plastic material surface, whereas at least one of the first, second, or center portions may include a paper material surface.

In yet another illustrative, non-limiting embodiment, a package may include a first end portion having a first extruded area configured to accommodate a proximal end of an air treatment device, the proximal end having a cylindrical shape. The package may also include a center portion coupled to the first end portion, a dimension of the center portion matching a size of a flange portion of the air treatment device. The package may further include a second end portion coupled to the center portion, the second end portion having a second extruded area configured to accommodate a distal end of the air treatment device, the distal end having a cubic shape.

In some implementations, the first end portion, the center portion, and the second end portion each includes one or more transparent surfaces. Moreover, at least one of the first or second ends may be configured to swivel around a side in common with the center portion.

The center portion may also include a hidden shelf configured to rest between the flange portion of the air treatment device and the second end portion. For example, the hidden shelf may have a cuboid shape and be configured to store at least one of: a product manual, a specification sheet, an assembly part, a fastener, and/or a tool. Additionally or alternatively, the center portion may include a back sleeve configured to rest between the flange portion of the air treatment device and the second end portion. For instance, the back sleeve may be configured to store a replacement flange for the air treatment device.

BRIEF DESCRIPTION OF THE DRAWINGS

Reference will now be made to the accompanying drawings, wherein.

While this specification provides several embodiments and illustrative drawings, a person of ordinary skill in the art will recognize that the present specification is not limited only to the embodiments or drawings described. It should be understood that the drawings and detailed description are not intended to limit the specification to the particular form disclosed, but, on the contrary, the intention is to cover all modifications, equivalents and alternatives falling within the spirit and scope of the claims. Also, any headings used herein are for organizational purposes only and are not intended to limit the scope of the description. As used herein, the word "may" is meant to convey a permissive sense (i.e., meaning "having the potential to"), rather than a mandatory sense (i.e., meaning "must"). Similarly, the words "include," "including," and "includes" mean "including, but not limited to."

DETAILED DESCRIPTION

This specification discloses systems and methods for packaging air treatment devices. Examples of "air treatment devices" include, but are not limited to, air filters, air purifiers, etc. In some embodiments, device 300 may be a photo-catalytic, duct-mounted air cleaner (e.g., an ultraviolet (UV) air cleaner) or the like. Although the embodiments discussed below may occasionally refer to specific types of air treatment devices, it should be understood that these examples are provided for sake of illustration only, and not by way of limitation.

Figure 1:
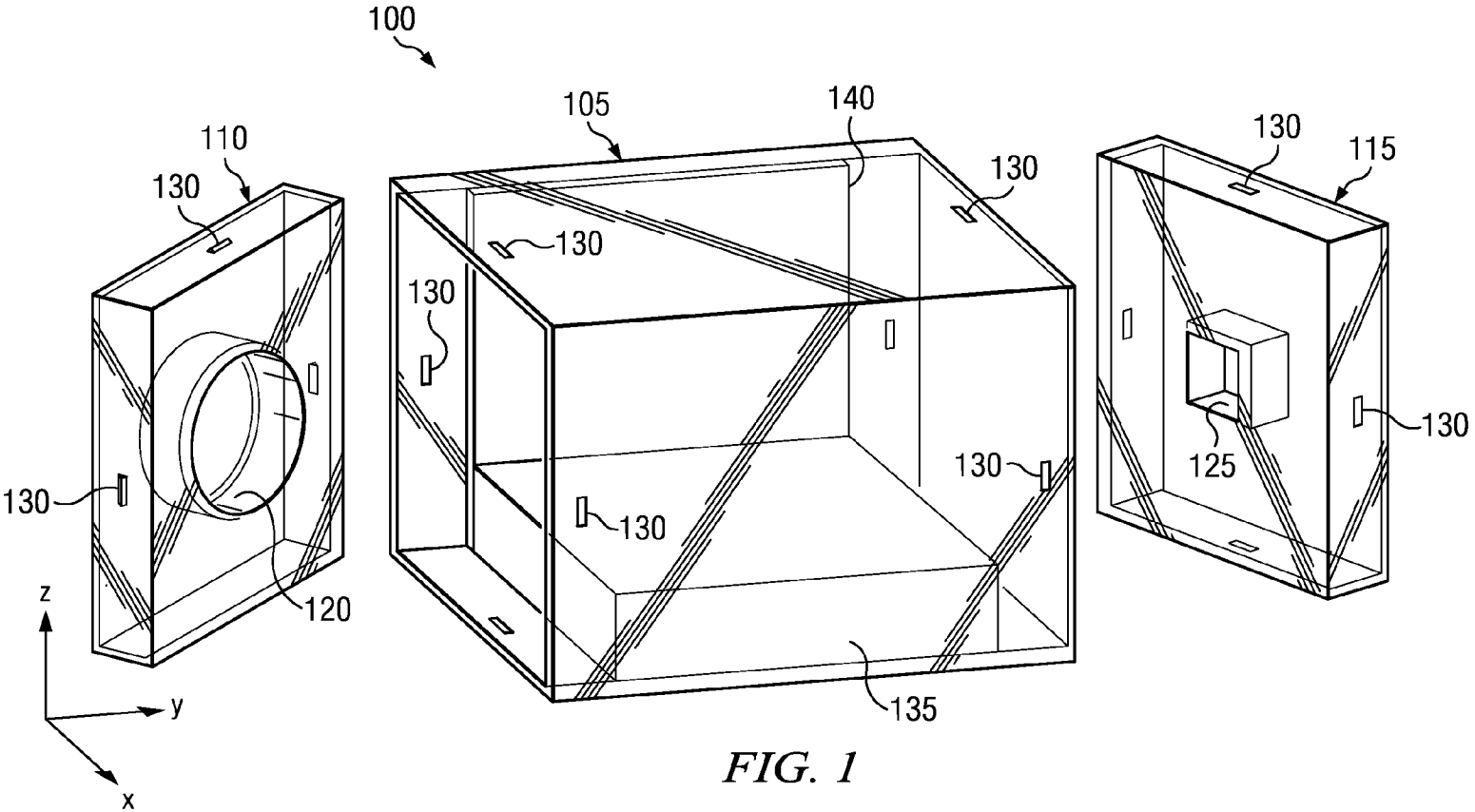
FIG. 1 is a perspective view of an illustrative package for an air treatment device according to some embodiments.

Turning now to FIG. 1, a perspective view of a package for an air treatment device is depicted according to some embodiments. As shown, package 100 includes first end portion 110, center portion 105, and second end portion 115. First end portion 110 may include first extruded area 120 configured to accommodate a proximal end of an air treatment device (shown in FIG. 3). In this non-limiting example, first extrusion 120 has a cylindrical shape. Center portion 105 may have a cubic or cuboid shape, and it may be hollow. The side of center portion 105 may have a dimension that matches the dimension of a flange portion of the air treatment device. Meanwhile, second end portion 115 may have second extruded area 125 configured to accommodate a distal end of the air treatment device. In this non-limiting example, second extrusion 125 has a cubic or cuboid shape.

Center portion 105 may also be configured to hold "hidden shelf" 135 where packaging materials (e.g., product manuals, specification sheets, assembly parts, fasteners, tools, etc.) may be stored. The back of center portion 105 may include sleeve 140 configured to store replacement or alternative parts (e.g., flanges, etc.) for the air treatment device. Both shelf 135 and sleeve 140 may be made with cardboard or paper materials, and may be imprinted with product description or other relevant information related to the air treatment device.

In various implementations, first and second end portions 110 and 115, as well as center portion 140, may be manufactured using any suitable materials. Examples of such materials include, but are not limited to, plastic-based materials (e.g., polypropylene, polyethylene, polyethylene terephthalate, etc.) and paper-based materials (e.g., chip board, paperboard, cardboard, corrugated fiberboard, etc.) In some cases, first end portion 110, second end portion 115, and center portion 140 may each have one or more faces or surfaces that are transparent or translucent. Conversely, one or more of these faces or surfaces may be opaque. When made from plastic materials, one or more elements shown in FIG. 1 may be formed, for example, through a suitable casting, pressing, molding, and/or extrusion process. Paper elements may be manufactured, for example, using die cut techniques (e.g., rotary or flat die cutters) or the like.

When assembled, package 100 may hold an air treatment device between first and second end portions 110 and 115, respectively. These end portions may be coupled to center portion 140, for example, using fasteners (e.g., staples, etc.) at one or more locations 130. Additionally or alternatively, first and second end portions 110 and 115 may be attached to center portion 140 using a heating tool, shrink wrapping tool, or the like.

Figure 2A:
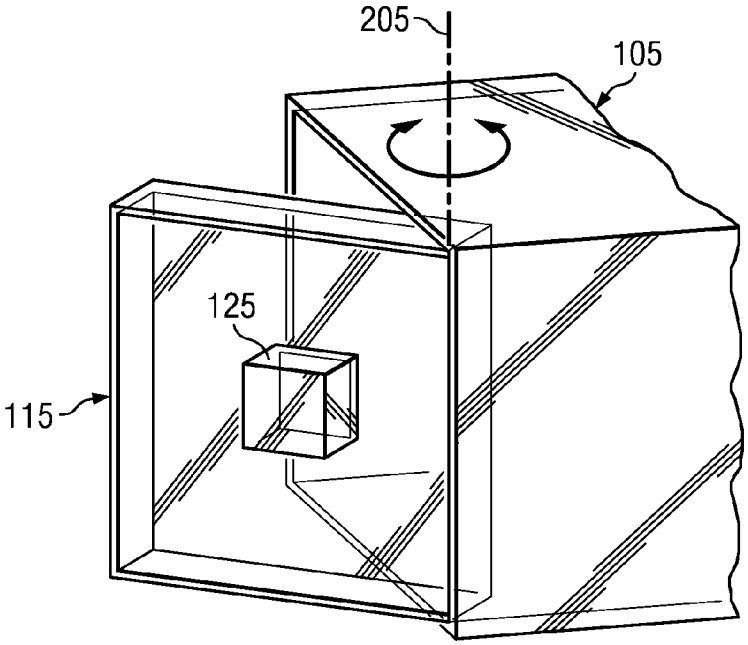
FIGS. 2A and 2B are perspective views of swiveling caps according to some embodiments.
Figure 2B:
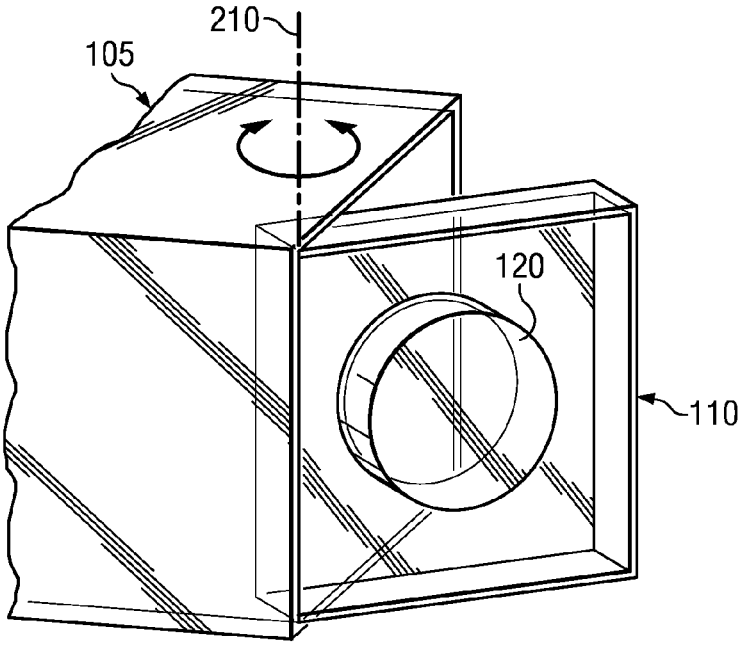

FIGS. 2A and 2B are perspective views of swiveling caps according to some embodiments. As depicted, first end portion 110 may share a side in common with center portion 105, and may be configured to swivel around axis 210 to open and close package 100. Similarly, second end portion 115 may share a side in common with center portion 105, and may be configured to swivel around axis 205 to open and close package 100.

Figure 3:
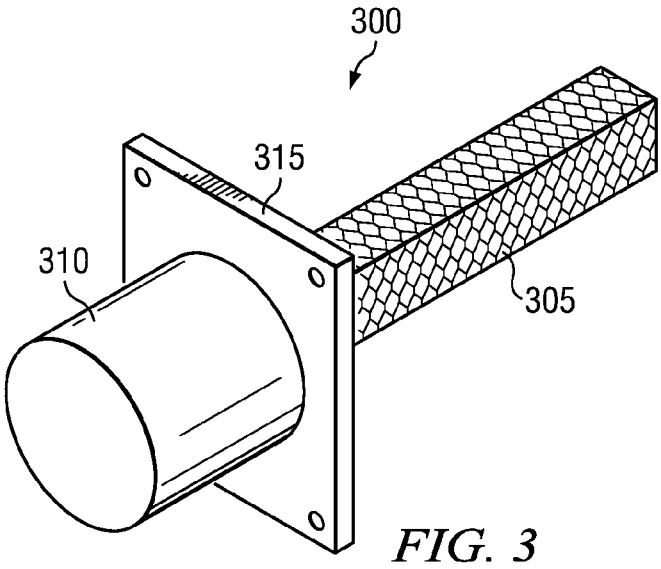
FIG. 3 is a perspective view of an air treatment device according to some embodiments.

FIG. 3 is a perspective view of an air treatment device according to some embodiments. As illustrated, device 300 may include housing portion 310 at its proximal end, flange 315, and air treatment element 305 at its distal end. Also, air treatment element 305 may include one or more honeycomb surfaces. In this non-limiting example, housing portion 310 has a cylindrical shape, flange 315 has a square shape, and element 305 has a cuboid shape. In other embodiments, however, one or more parts of device 300 may have a different shape (in which case respective end portions 110 and/or 115 may have extrusions 120 and/or 125 matching that different shape).

Generally speaking, housing 310 may include a power supply, switch, and/or other electronic components. Flange 315 may include a metal face coupled to gasket or rubber seal, and element 305 may include an ionizing element or the like, which is activated under control of the components within housing 310. When installed in an HVAC duct, for example, a contractor may drill or saw a hole in the duct sufficiently large for inserting element 305 but smaller than flange 315, such that device 300 may be attached to the duct using flange 315 to seal any potential air leaks while leaving housing 310 accessible from outside the duct.

Figure 4:
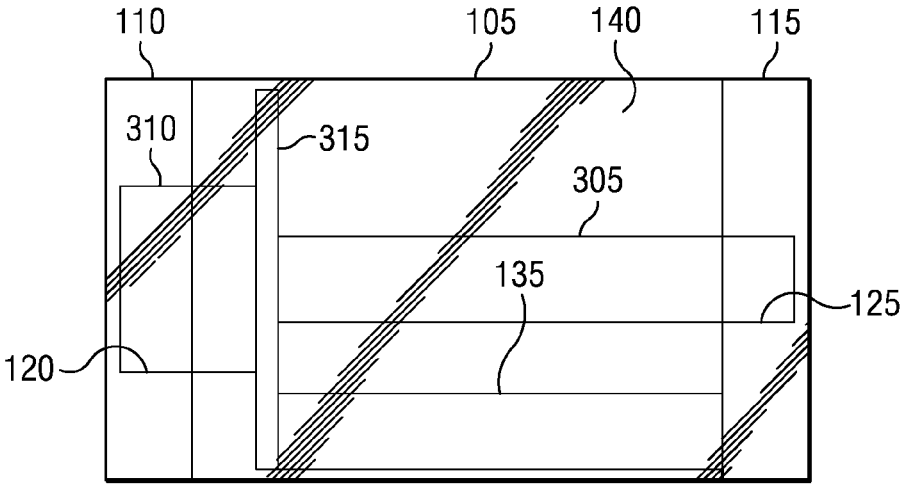
FIG. 4 is a frontal view of the package shown in FIG. 1, according to some embodiments.

FIG. 4 is a frontal view of the package shown in FIG. 1, according to some embodiments. As illustrated, housing 310 of device 300 may at least partially rest within extrusion 120 of first end portion 110, and air treatment element 305 may at least partially rest within extrusion 125 of second end portion 115. Flange 315 may have a dimension that matches an internal dimension of central portion 105, and it may rest against shelf 135 and sleeve 140.

Figure 5A:
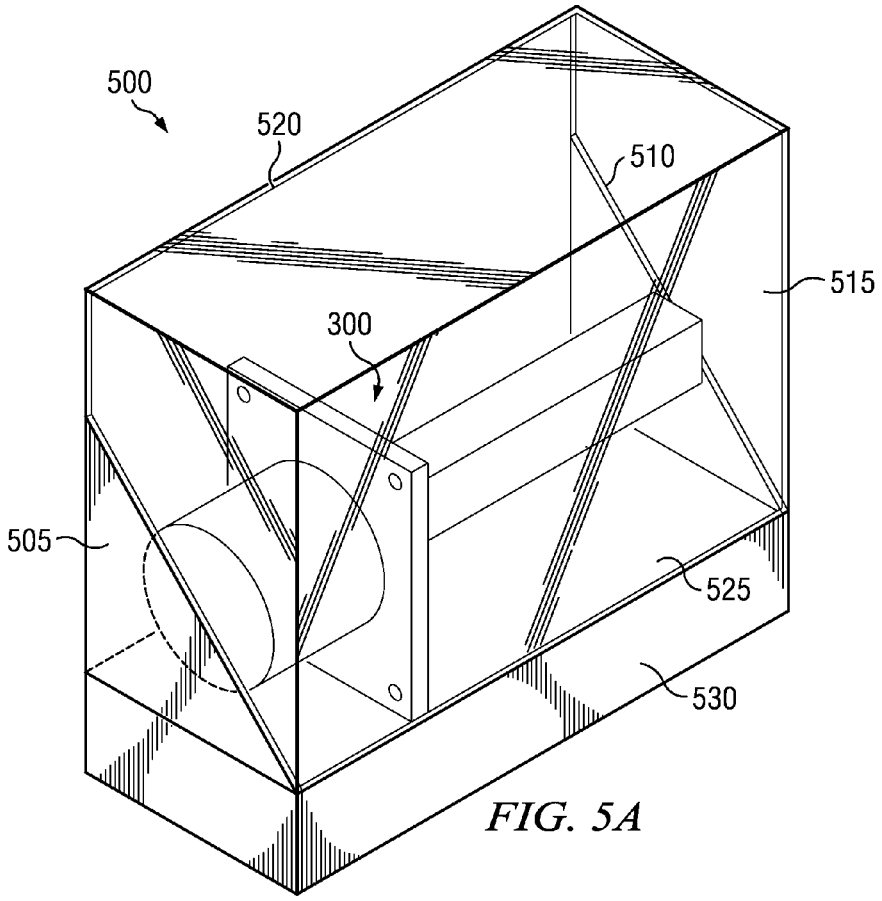
FIGS. 5A and 5B are perspective and frontal views, respectively, of another package for an air treatment device according to some embodiments.
Figure 5B:
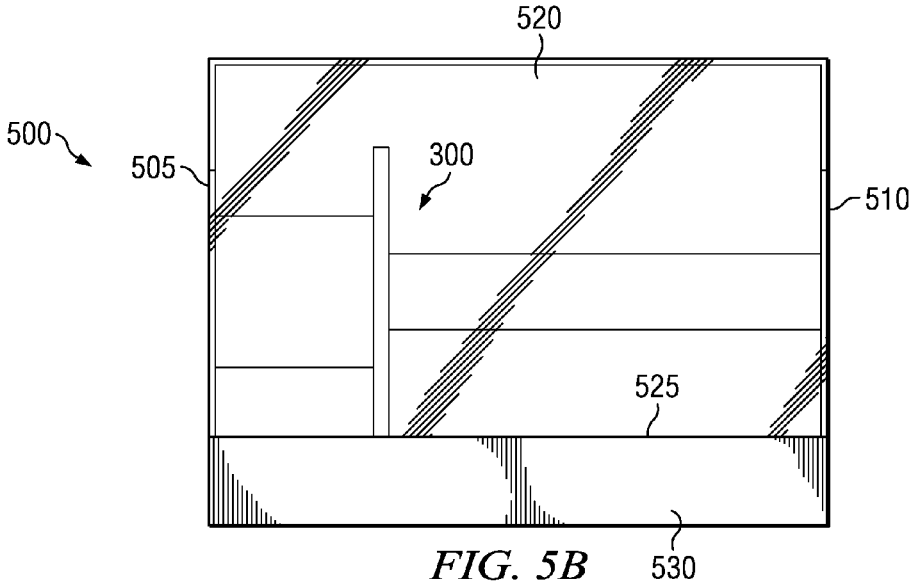

FIGS. 5A and 5B are perspective and frontal views, respectively, of another package for an air treatment device according to some embodiments. As illustrated, package 500 includes first end portion 505 and second end portion 510. First end portion 505 may be configured to accommodate a proximal end of air treatment device 300, whereas second end portion 510 may be configured to accommodate a distal end of air treatment device 300. In this non-limiting example, end portions 505 and 510, back portion 520, and front portion 530 may be manufactured using paper-based materials (e.g., cardboard), as described above. A transparent or plastic-based cover 515 (e.g., in the shape of a hollow prism) may allow a customer to inspect device 300 without having to open package 500, while giving package 500 a cuboid shape. Also, in this case, "hidden shelf" 525 may be used to store, for example, product manuals, specification sheets, assembly parts, fasteners, tools, etc. Similarly as described above with respect to FIG. 1, here back portion 520 may include a sleeve configured to store replacement or alternative parts (e.g., flanges, etc.) for air treatment device 300. Again, back portion 520, end portions 505 and 510, and/or front portion 530 and may be imprinted with product description or other relevant information related to air treatment device 300.

Figure 6A:
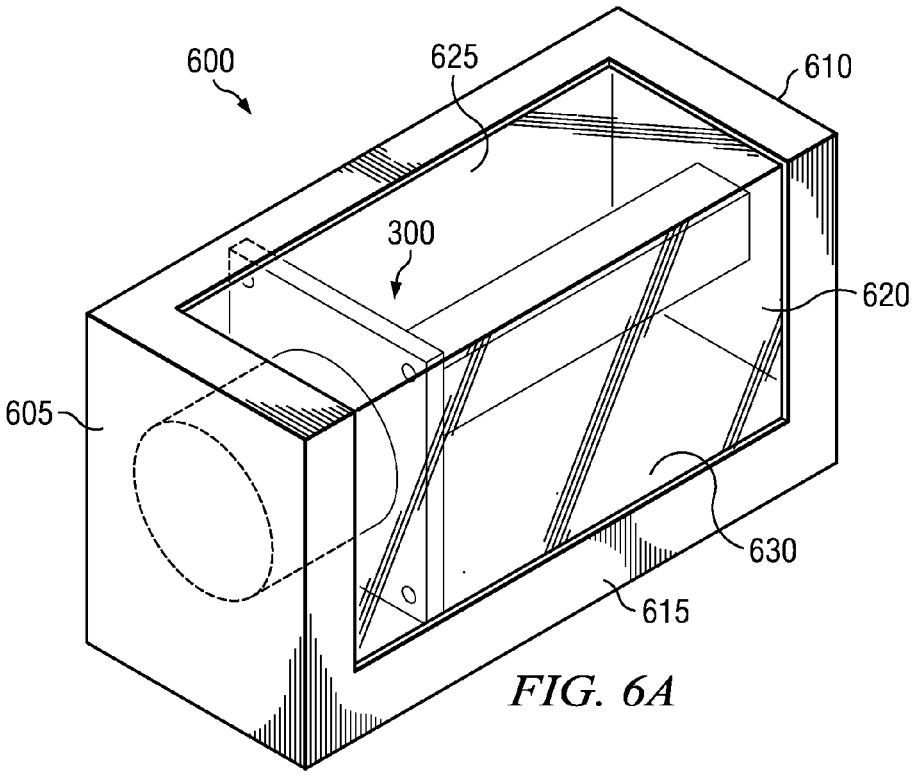
FIGS. 6A and 6B are perspective and frontal views, respectively, of yet another package for an air treatment device according to some embodiments.
Figure 6B:
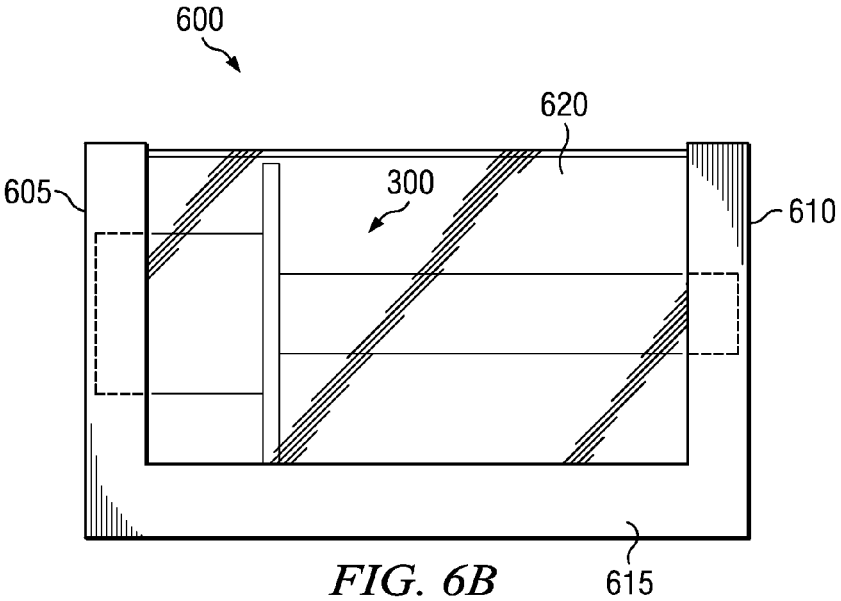

FIGS. 6A and 6B are perspective and frontal views, respectively, of yet another package for an air treatment device according to some embodiments. As shown, package 600 includes first end portion 605 and second end portion 610. As before, end portion 605 may also be configured to accommodate a proximal end of device 300 and second end portion 610 may be configured to accommodate a distal end of device 300. In this non-limiting example, end portions 605 and 610, and border or lateral portion 615 may be manufactured using paper-based materials (e.g., cardboard). Front portion 620 and top portion 625 may serve as a transparent or plastic-based cover (e.g., in an "L" shape) as to allow a customer to visually inspect device 300. Similarly as described above, in some cases "hidden shelf" 630 may also be provided.

Figure 7A:
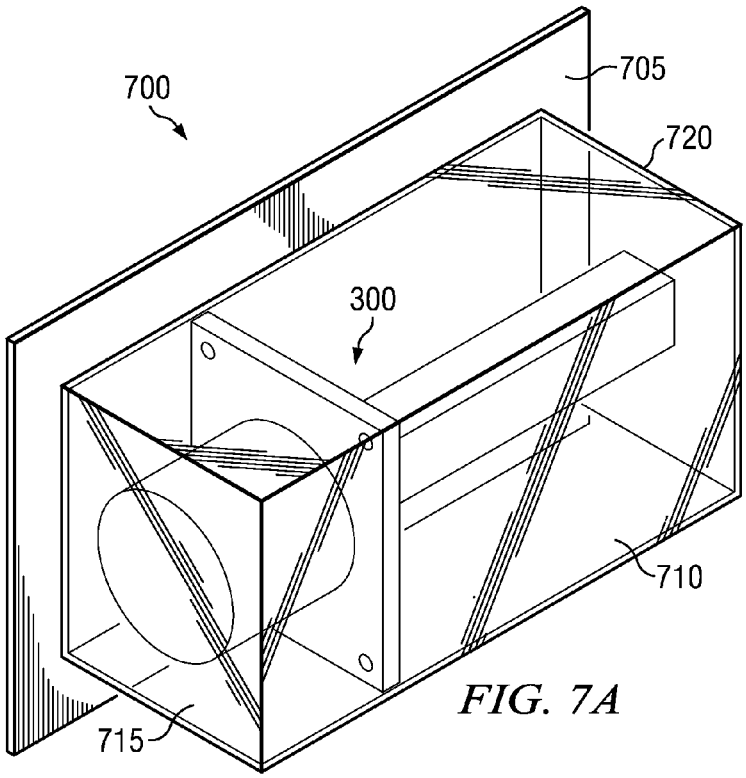
FIGS. 7A and 7B are perspective and frontal views, respectively, of still another package for an air treatment device according to some embodiments.
Figure 7B:
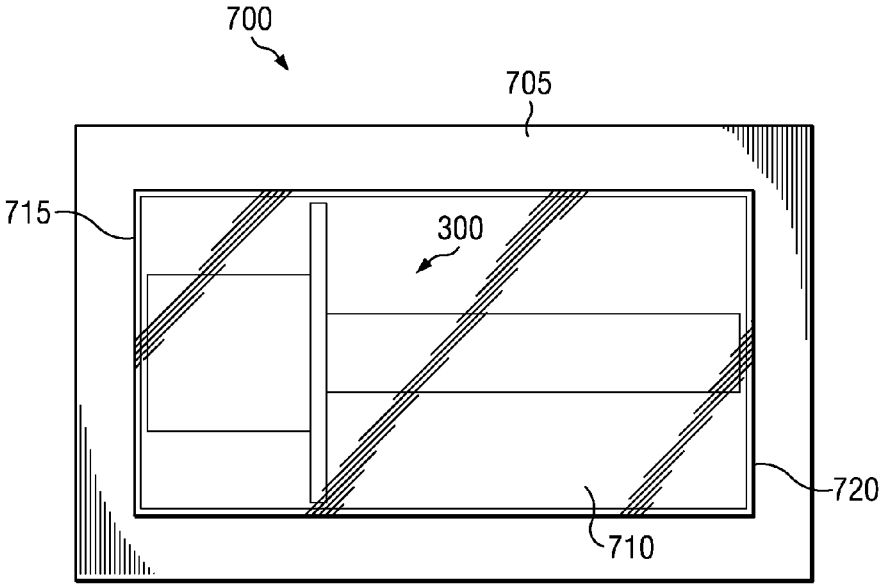

FIGS. 7A and 7B are perspective and frontal views, respectively, of still another package for an air treatment device according to some embodiments. As depicted, package 700 may include back portion or sleeve 705, as well as transparent or plastic box 710, which may be glued, stapled, or otherwise coupled to backing portion 705. End portion 715 may be configured to accommodate a proximal end of device 300, whereas second end portion 720 may be configured to accommodate a distal end of device 300.

Figure 8A:
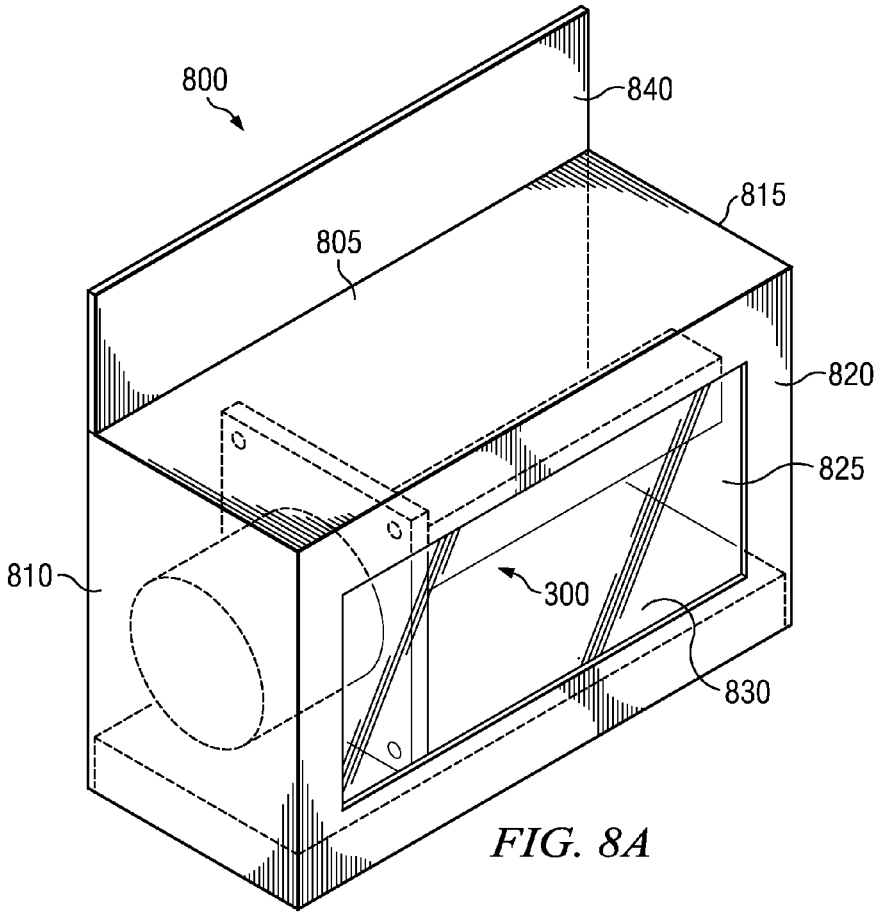
FIGS. 8A and 8B are perspective and frontal views, respectively, of yet another package for an air treatment device according to some embodiments.
Figure 8B:
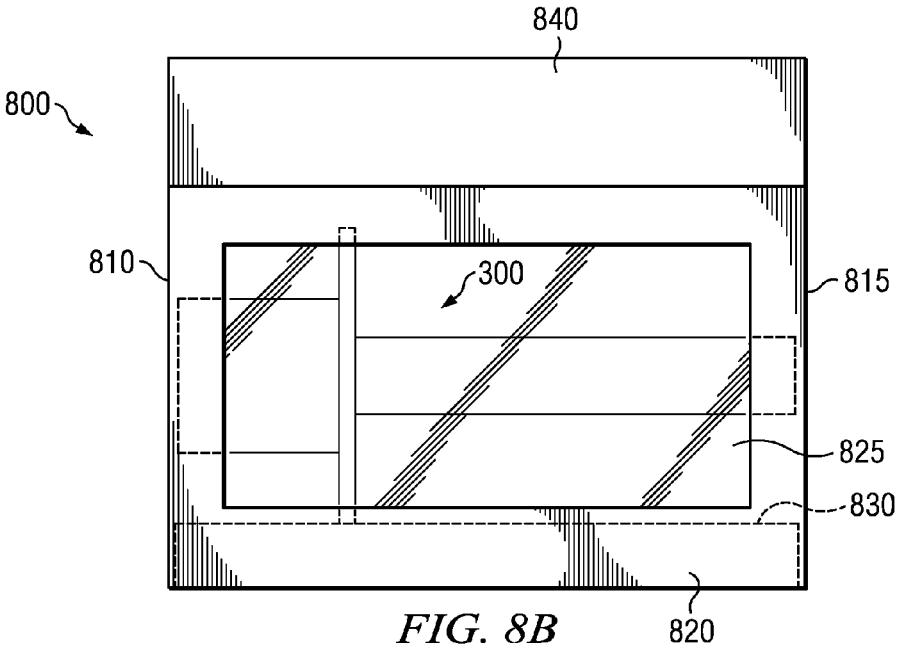

FIGS. 8A and 8B are perspective and frontal views, respectively, of yet another package for an air treatment device according to some embodiments. As illustrated, package 800 includes first end portion 810 configured to accommodate a proximal end of device 300 and second end portion 815 configured to accommodate a distal end of device 300. In this non-limiting example, end portions 605 and 610, to portion 805, and border or lateral portion 820 may be manufactured using paper-based materials (e.g., cardboard). Front portion 825 may include a transparent or plastic-based surface to reveal device 300. In some cases "hidden shelf" 830 may also be provided The various systems and methods illustrated in the figures and described herein represent example embodiments of systems and methods for packaging air treatment devices. In some cases, the air treatment device may be held in place inside its packaging by using twist ties, tie wires, etc. Additionally or alternatively, a paper or plastic portion of the packaging may include an internal surface that is molded to conform to the shape of the air treatment device, thus securely holding it in place. It should be noted that, while aesthetically pleasing, the boxes and packages shown and described herein make it easier for a customer visually inspect the air treatment device without having to open the box, for example, to determine its size, manner of installation, installed appearance, and suitability for a given project.

The order in which each operation of a given method is performed may be changed, and various elements of the systems or devices illustrated herein may be added, reordered, combined, omitted, modified, etc. Various modifications and changes may be made as would be clear to a person of ordinary skill in the art having the benefit of this specification. It is intended that the invention(s) described herein embrace all such modifications and changes and, accordingly, the above description should be regarded in an illustrative rather than a restrictive sense.

The invention claimed is:

1. A package, comprising:

a first end portion having a first extruded area configured to accommodate a proximal end of an air treatment device, the proximal end having a cylindrical shape;

a center portion coupled to the first end portion, a dimension of the center portion matching a size of a flange portion of the air treatment device; and a second end portion coupled to the center portion, the second end portion having a second extruded area configured to accommodate a distal end of the air treatment device, the distal end having a cubic shape, the center portion comprising a hidden shelf configured to rest between the flange portion of the air treatment device and the second end portion.

2. The package of claim 1, wherein the first end portion, the center portion, and the second end portion each includes one or more transparent surfaces.

3. The package of claim 2, wherein the one or more transparent surfaces are plastic surfaces.

4. The package of claim 1, wherein at least one of first end portion, the center portion, or the second end portion includes one or more opaque surfaces.

5. The package of claim 4, wherein the one or more opaque surfaces are paper surfaces.

6. The package of claim 1, the hidden shelf having a cuboid shape and configured to store at least one of: a product manual, a specification sheet, an assembly part, a fastener, or a tool.

7. The package of claim 1, the center portion further comprising a back sleeve configured to rest between the flange portion of the air treatment device and the second end portion.

8. The package of claim 7, the back sleeve configured to store a replacement flange for the air treatment device.

9. The package of claim 1, at least one of the first or second end portions configured to swivel around a side in common with the center portion.

10. A package, comprising:

a first end portion having a first extruded area configured to accommodate a proximal end of an air treatment device, the proximal end having a cylindrical shape;

a center portion coupled to the first end portion, a dimension of the center portion matching a size of a flange portion of the air treatment device; and a second end portion coupled to the center portion, the second end portion having a second extruded area configured to accommodate a distal end of the air treatment device, the distal end having a cubic shape, the center portion further comprising a back sleeve configured to rest between the flange portion of the air treatment device and the second end portion, the back sleeve configured to store a replacement flange for the air treatment device.

11. The package of claim 10, wherein the first end portion, the center portion, and the second end portion each includes one or more transparent surfaces.

12. The package of claim 11, wherein the one or more transparent surfaces are plastic surfaces.

13. The package of claim 10, wherein at least one of first end portion, the center portion, or the second end portion includes one or more opaque surfaces.

14. The package of claim 13, wherein the one or more opaque surfaces are paper surfaces.

15. The package of claim 10, the center portion comprising a hidden shelf configured to rest between the flange portion of the air treatment device and the second end portion.

16. The package of claim 15, the hidden shelf having a cuboid shape and configured to store at least one of: a product manual, a specification sheet, an assembly part, a fastener, or a tool.

17. The package of claim 10, at least one of the first or second end portions configured to swivel around a side in common with the center portion.

* * * * *